US006046962A

United States Patent [19]

Suppa et al.

[11] Patent Number: 6,046,962

[45] Date of Patent: Apr. 4, 2000

[54] ELECTRODYNAMIC TRANSDUCER FOR UNDERWATER ACOUSTICS

[75] Inventors: Vito Suppa, Roquefort les Pins; Jean Bertheas, Villeneuve-Loubet, both of France

[73] Assignee: Thomson Marconi Sonar SAS, Sophia Antipolis, France

[21] Appl. No.: 09/084,741

[22] Filed: May 27, 1998

[30] Foreign Application Priority Data

May 27, 1997 [FR] France ..... 97 06457

[51] Int. Cl.[7] ..... B06B 1/00

[52] U.S. Cl. ..... 367/172

[58] Field of Search ..... 367/172, 173, 367/171, 167, 142; 181/120

[56] References Cited

U.S. PATENT DOCUMENTS

| | | |
|---|---|---|
| 2,545,961 | 3/1951 | Levy . |
| 3,435,407 | 3/1969 | Bertheas . |
| 3,639,695 | 2/1972 | Bertheas . |
| 3,745,956 | 7/1973 | Bertheas . |
| 3,761,821 | 9/1973 | Bertheas . |
| 3,835,448 | 9/1974 | Bertheas . |
| 4,029,141 | 6/1977 | Ferrari et al. . |
| 4,279,025 | 7/1981 | Suppa . |
| 4,295,211 | 10/1981 | Suppa et al. . |
| 4,380,440 | 4/1983 | Suppa . |
| 4,466,083 | 8/1984 | Willard et al. . |
| 4,480,322 | 10/1984 | Orieux et al. . |
| 5,058,082 | 10/1991 | Bertheas et al. . |
| 5,062,089 | 10/1991 | Willard et al. ..... 367/172 |

FOREIGN PATENT DOCUMENTS 1 161 895 2/1984 Canada .

*Primary Examiner*—Daniel T. Pihulic
*Attorney, Agent, or Firm*—Oblon, Spivak, McClelland, Maier & Neustadt, P.C.

[57] ABSTRACT

Disclosed is an electrodynamic transducer designed to emit acoustic waves in a sea environment. The dome of a transducer such as this is provided with a horn sliding in the body of the transducer with an adjutage whose clearance is extremely small. This reduces the effects of a shock wave coming from a possible external explosion and prevents the tearing of the tight-sealing membrane between the horn and the body. Radial ribs increase the stiffness of this mobile structure. A toroidal, elastic air chamber provides compensation for the effects of the hydrostatic pressure and of gravity on the mobile structure. The disclosure provides transducers that are resistant to external explosions.

16 Claims, 1 Drawing Sheet

ELECTRODYNAMIC TRANSDUCER FOR UNDERWATER ACOUSTICS

BACKGROUND OF THE INVENTION

1. Field of the Invention

The present invention relates to electrodynamic type transducers that enable the transmission, within the sea, of acoustic waves and more particularly sound waves. These transducers are particularly useful in sonar technology.

2. Description of the Prior Art

It is the practice in underwater acoustics to use towed fish comprising electronic instruments and various transducers that can work in transmission, reception and possibly in both transmission and reception.

It is known that in order to be able to emit sufficient acoustic power at low frequencies, typically frequencies of 10 Hz to 1 kHz, it is necessary to move substantial masses of water. This requires a shift, itself substantial, of the active face of the transducer. This generally leads to the use, in this case, of an electrodynamic type transducer comprising a horn driven by a mobile coil located in a gap. Transducers of this type are thus quite similar to loudspeakers which are well known in musical acoustics.

To be able to obtain the acoustic power frequently needed in certain applications, given the acoustic level to be attained which can be as much as 150 dB at 10 Hz, it becomes necessary to use relatively large-sized transducers. This leads to constraints, in volume as well as in weight, because the transducer has to be immersed in the sea while being placed in a fish that has to navigate at a predetermined depth of immersion.

Moreover, the transducer often needs to be capable of withstanding the explosions that may sometimes occur in particular applications. The effect of an underwater explosion of this kind results in the application, to the transducer; of a level of hydrostatic pressure and acceleration. This level of hydrostatic pressure and acceleration is easily destructive at the horn and at the tight-sealing membrane between the horn and the transducer pack.

There is an electrical transducer for underwater acoustics more particularly known from the U.S. Pat. No. 4,466,083. This electrodynamic transducer can indeed be used to deliver high acoustic power, but is primarily designed to circumvent the problems due to heat dissipation corresponding to losses from electrical/acoustic conversion. The structure of this transducer does not enable it to resist underwater explosions. These explosions, if they occurred, would quickly make the transducer unusable by tearing its membrane, crushing its dome and causing deterioration to its draw-back springs.

In one known technique for resisting such explosions, a dome drilled with holes is placed over the horn of such a transducer, and the dome itself is covered with a membrane. Each of the holes thus forms a valve that lets through the vibrations corresponding to the acoustic signals emitted by the transducer, and does not let through the peaks of pressure that come from explosions if any. Such a system however has the disadvantage of increasing the volume and the mass of the transducer, and of decreasing the level of sound that it can deliver.

SUMMARY OF THE INVENTION

To mitigate these disadvantages, the invention proposes an electrodynamic transducer for underwater acoustics, of the type comprising a body fitted with pole pieces defining a gap, a mobile structure fitted with a dome extended by a cylinder supporting a coil that slides in this gap, and a flexible membrane that provides tight sealing between the mobile structure and the body, wherein chiefly said transducer further comprises a horn surmounting said dome and sliding in said body by forming an adjutage with said body, the value of whose play is fixed so as to enable the protection of said membrane against the shock waves coming from explosions external to the transducer by flattening these shock waves in said adjutage.

According to another characteristic, the mobile structure further comprises a set of radial ribs fixed on one side to the interior wall of this mobile structure and joined together on the other side in a star arrangement to increase the stiffness of this mobile structure and its resistance to said shock wave.

According to another characteristic, the transducer further comprises a spring fixed at its periphery to the lower part of the body and connected at its center to the center of the star formed by the meeting of said ribs, this spring enabling the mobile structure to be centered along the vertical axis.

According to another characteristic, the transducer further comprises a peripheral cavity made in the body and connected to the external environment by at least one perforation and a toroidal, elastic air chamber contained in this peripheral cavity connected to the lower cavity defined by the body and the mobile structure to compensate for the effects of the hydrostatic pressure due to the immersion; the difference in height between the horn and this air chamber enabling the mobile structure to be maintained in a neutral position.

BRIEF DESCRIPTION OF THE DRAWINGS

Other features and advantages of the invention shall appear clearly in following description, given by way of a non-restrictive example with reference to the appended figures, of which.

MORE DETAILED DESCRIPTION

Figure 1:
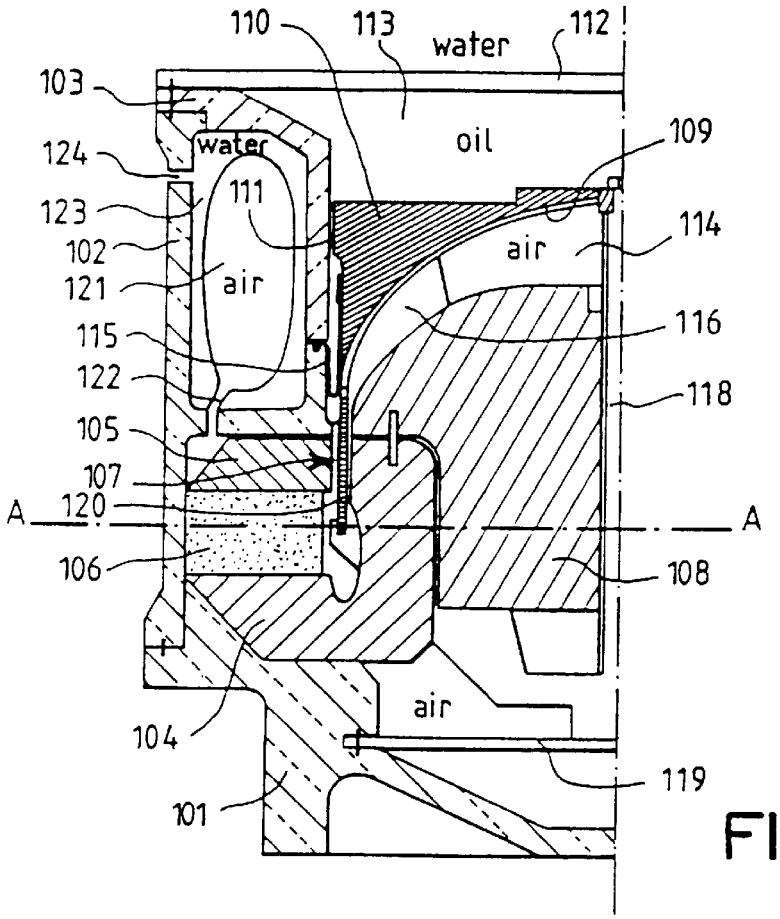
FIG. 1 shows a vertical cross-section of half of a transducer according to the invention.
Figure 2:
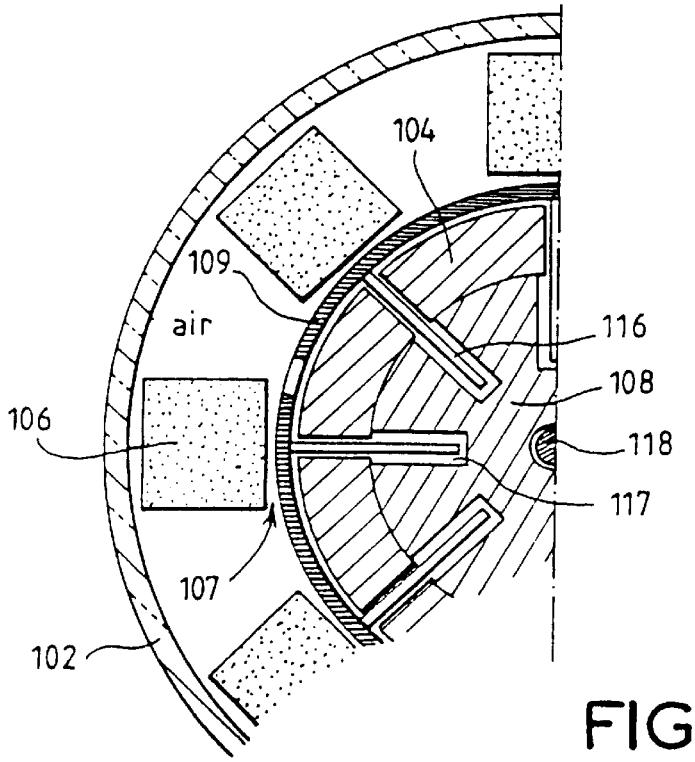
FIG. 2 shows a horizontal view along the plane AA of the transducer of FIG. 1.

The transducer according to the invention shown in the two appended figures comprises a body formed by a base 101 into which there is fixed a jacket 102 surmounted by a cup 103. These different parts are fitted into one another so as to demarcate cylindrical cavities with a shape generated by revolution around the axis of the transducer, and the other parts forming this transducer get inserted into these cylindrical cavities.

A first cylindrical cavity demarcated between the base and the jacket makes it possible to maintain a magnetic circuit formed by a first pole piece and a second pole piece, 104 and 105, in the shape of crowns centered on the axis of the transducer. The first pole piece 104 is L-shaped with the inner arm of the L extending into the central chamber of the transducer. The second pole piece 105 has the shape of a flat washer or disc. Both are kept separate by a set of magnets 106 to which they are clamped by the adjustment of the jacket 102 in the base 101. In this way, there is obtained a magnetic circuit that is stopped only by a thin gap 107 taking the shape of a cylinder centered on the axis of the transducer and coming to a position where it is flush with the internal lateral surface of the cup 103.

The central space of the body of the transducer forms a second cylindrical cavity in which a mushroom-shaped core 108 gets embedded by its central stem in the central circular aperture of the pole piece 104. The lower part of the head of the core, which has an appreciably hemispherical shape, rests on the upper part of this same pole piece 104.

The mobile structure of the transducer is formed by a hollow part 109 having the shape of a dome capping a cylindrical part that gets engaged in the gap 107. In order that this part may be very solid, very light and very rigid all at the same time, it is formed for example by a carbon fibre fabric embedded in a resin matrix. According to the invention, the upper surface of the dome 109 is covered with a part 110 whose upper surface is appreciably flat. This part 110 forms the radiating horn of the transducer. So that it may be very light, it is made for example out of syntactic foam.

The horn 110 thus behaves like a piston whose lateral external surface is cylindrical. This piston slides in a cylinder formed by the lateral internal surface of the cup 103, which is itself appreciably cylindrical. According to the invention, these two parts, and more particularly the horn 110, are made so as to have an extremely tight-fitting clearance of about 0.2 mm for example. Thus a mechanical filter is formed. This mechanical filter slows down the propagation of the shock wave that could arise out of an external explosion if any by flattening, in this interstice, the fluid in which the horn bathes.

To protect the horn, the upper part of the central space of the body of the transducer is filled, a known way, with a fluid, an oil for example, suited both to this protection and to the propagation of the acoustic waves. To prevent this oil from escaping, the space 113 is closed at its upper part by a membrane 112 fixed to the rim of the cup 103.

To enable the play of the dome and the horn, the lower part of the central space, opposite the part in which this oil is located, is for its part filled with air. To then prevent the oil contained in the part 113 from re-entering the air-filled part 114, another tight-sealing membrane 115 is used. This tight-sealing membrane is made of rubber for example. It is much more flexible than the membrane 112 and is fixed, on the one hand, to the external lateral wall of the horn 110 and on the other hand on the interior side wall of the cup 103. In this exemplary embodiment, this fixing is obtained by clamping between this cup 103 and the jacket 102. To enable a free and appropriate play of this membrane between the horn and the cup, the external side surface of the horn is machined on this level so as to be recessed with respect to the adjutage 111 with the reduced clearance described here above, and so as to form an unoccupied space for the membrane 115.

By way of an alternative, to prevent the oil contained in the cavity 113 from impregnating the syntactic foam 110 in increasing its mass, it is possible to envisage making the external surface of this horn impervious by covering it with a fine layer made up of a carbon fibre fabric embedded in a resin matrix.

Moreover, so that the play of the adjutage 111 can be maintained despite the bending loads applied to the dome 109 and the horn 112 during the play undergone by these parts when the transducer works with high emission power, the invention proposes to stiffen this assembly by using a set of radial ribs 116 that are distributed on the inner periphery of the dome 109 and meet in a star arrangement below the lower part of the stem of the mushroom forming the core 108. These ribs slide in grooves 117 made in the core 116 and the first pole piece 104. These grooves are relatively broad at the core and are narrower at the pole piece to minimize the loss of magnetic flux, which can be reduced to a very low value of a few percent.

An shaft 118 joins the center of the upper part of the dome 109 to the center of the star formed by the meeting of the ribs 116, below the lower face of the core 108. This shaft makes it possible to stiffen the assembly and, at the same time, to ensure its vertical centering in relation to the axis of the transducer. To fulfill this second function, the shaft is fixed by its lower part to the center of a leaf spring 119 that is itself fixed circumferentially in the lower part of the base 101. This spring, of the type known as a <<flector>>, is formed by a flexible and elastic disc with circumferential apertures that let air pass freely into the lower part of the central space of the transducer, between the two parts demarcated by the plane of this spring. This spring not only ensures the centering but also prevents rotational movements in the mobile structure that make the ribs rub against the walls of the grooves in which they slide.

The driving action which makes it possible to move the domehorn unit along the axis of the transducer, to emit acoustic waves, is obtained by the interaction between the magnetic field that circulates between the pole pieces and the magnetic field delivered by a coil 120 wound on the lateral flanks of the lower cylindrical part of the dome 109. This coil is thus plunged in the gap existing between the two pole pieces. This gives the standard arrangement of an electrodynamic transducer. This coil is fed by means that are not shown on the figure and are known in the prior art.

In addition to the function of stiffening the mobile structure, the ribs 116 also serve as a heat sink all along the height of the coil 120, to dissipate the heat released at this level in directing it towards the other parts of the transducer.

The internal part 114 demarcated by the dome 109, the base 101 whose bottom is closed, the jacket 102 and the tight-sealing membrane 115 is filled with air to allow the play of the mobile structure, as was seen further above.

When the transducer is immersed, the mobile structure, under the effect of the hydrostatic pressure, plunges towards the bottom of the base 101 by compressing the spring 119 and the volume of air included in this part 114. This motion naturally tends to modify the electroacoustic characteristics of the transducer, in particular by modifying the respective positions of the coil and of the pole pieces.

To compensate, at least partly, for this effect, a compensation reservoir or air chamber 121 is used. This air chamber 121 is formed by a flexible pocket, made of rubber for example, subjected to the pressure of the marine environment and communicating with the part 114 by means of a conduit 122. According to the invention, to protect this air chamber against the effect of possible explosions occurring in the marine environment, it has a toroidal shape and is located in another internal cylindrical cavity 123 that is demarcated within the transducer by the walls of the jacket 102 and the cup 103. This cavity is thus itself toroidal and closed, and it surrounds the site of the horn 110. To make it possible for the air chamber placed inside this cavity to be subjected to marine pressure, small apertures 124 are made in the lateral external wall of the jacket 102. These apertures 124 allow sea water to penetrate the cavity 123 and compress the air chamber. In this way, the air chamber is protected against external mechanical aggression by the walls of the cavity in which it is located. Moreover the diameter of the apertures 124 is designed so that the shock waves coming from any external explosion are attenuated when passing through these apertures, so that they do not present any danger of excess pressure in the air chamber. Since these apertures are round, their diameter can be greater than the thickness of the adjutage 111.

Since transducers of this type are generally designed to function so as to emit the acoustic waves downwards, hence in the reverse position to the one shown in FIG. 1, the movement of the mobile structure towards the bottom of the body 101 under the effect of the hydrostatic pressure is then opposed simultaneously by the action of the spring 119, the action of gravity on the entire mobile structure, and the action of the hydrostatic pressure on the air chamber 121.

To balance the mobile structure in a position such that spring 119 is in its resting position, with the pressure on the surface of the horn then balancing the pressure on the air chamber, the invention proposes to set the dimensions of these various parts in such a way that there is a difference ΔH between the plane of the external surface of the horn and the average position of the air chamber; this distance being such that the difference in hydrostatic pressure between this surface and the air chamber, due to the difference between the immersions, balances the weight of the mobile structure. Calculations show that with a value M for the mass of the mobile structure, a surface S for the emissive surface of the horn and a density ρ for the marine environment, this difference in altitude is given by:

$$\Delta h = m/s\ \rho$$

By taking values, current for a horn of this kind, of a diameter of 200 mm and a weight of 1.5 kg, the difference in altitude is then equal to 48 mm.

As and when the transducer gets immersed, the position of the mobile structure remains appreciably fixed while the air tube gets retracted. This phenomenon proceeds until the air chamber is completely retracted. There is then a maximum immersion from which there can be no more compensation for the hydrostatic pressure. Assuming $V_T$=the volume of air in the transducer, $V_c$=the volume of air in the room, $p_{max}$ the pressure at maximum immersion and $p_{min}$ with minimal immersion, the relationship between these values is given by:

$$p_{max}\ \mathrm{VT} = p_{min}(VT+VC)$$

This formula makes it possible, for a given construction, to obtain the maximum value of the immersion, and for a maximum value of desired immersion, to obtain the value of the volume of the air chamber, and hence the setting of its dimensions as well as those of the parts containing it.

Thus for example a transducer having to be immersed with a 30 m depth must have an air chamber whose volume is appreciably equal to 3 times the volume of air in the remainder of the transducer. We thus see the usefulness of the core 108 which makes it possible to minimize the internal volume of the transducer, and thus to increase the depth of immersion, all things being equal.

What is claimed is:

1. An electrodynamic transducer for underwater acoustics, comprising:

a body fitted with pole pieces defining a gap;

a mobile structure fitted with a dome extended by a cylinder configured to support a coil that slides in said gap;

a flexible membrane configured to provide tight sealing between the mobile structure and the body; and a horn configured to surmount said dome and to slide in said body by forming an adjutage with said body, said adjutage having a fixed play value so as to protect said membrane against shock waves coming from explosions external to the electrodynamic transducer by flattening said shock waves in said adjutage.

2. A transducer according to claim 1, wherein the mobile structure further comprises a set of radial ribs fixed on one side to an interior wall of said mobile structure and joined together on the other side in a star arrangement so as to increase the stiffness of said mobile structure and the resistance of said mobile structure to said shock waves.

3. A transducer according to claim 2, further comprising a spring fixed at a periphery of said spring to the lower part of the body and connected at the center of said spring to the center of the star formed by said ribs, said spring being configured to allow the mobile structure to be centered along the vertical axis.

4. A transducer according to any of the claims 1 to 3, further comprising:

a peripheral cavity in the body, said peripheral cavity being connected to an external environment by at least one perforation and a toroidal; and an elastic air chamber contained in said peripheral cavity, said elastic air chamber being connected to a lower cavity defined by the body and the mobile structure to compensate for effects of hydrostatic pressure due to immersion, wherein a difference in height between the horn and said elastic air chamber enables the mobile structure to be maintained in a neutral position.

5. A transducer according to claim 1, wherein said mobile structure comprises a carbon fiber fabric embedded in a resin matrix.

6. A transducer according to claim 1, wherein said horn comprises foam.

7. A transducer according to claim 1, further comprising a set of magnets configured to separate said pole pieces.

8. A transducer according to claim 1, wherein said pole pieces comprise a first pole piece having an L-shape and a second pole piece having a shape of a flat washer.

9. A transducer according to claim 1, further comprising a fluid cavity configured to protect said horn.

10. A transducer according to claim 9, wherein said fluid cavity comprises oil.

11. A transducer according to claim 2, further comprising a shaft configured to join the center of an upper part of said dome to the center of the star formed by said ribs.

12. A transducer according to claim 1, further comprising a core embedded in said body.

13. A transducer according to claim 12, wherein said core has a mushroom shape with a stem part and a head part.

14. A transducer according to claim 13, wherein said stem part is embedded in a central circular aperture of one of said pole pieces.

15. A transducer according to claim 13, wherein a lower part of said head part rests on an upper part of one of said pole pieces.

16. A transducer according to claim 12, further comprising a shaft configured to join the center of an upper part of said dome to the center of the star formed by said ribs, below a lower face of said core.

* * * * *